US005979419A

United States Patent [19]

Toyoda

[11] Patent Number: 5,979,419

[45] Date of Patent: Nov. 9, 1999

[54] APPARATUS FOR CONTROLLING THE AIR-FUEL RATIO IN AN INTERNAL COMBUSTION ENGINE

[75] Inventor: Katsuhiko Toyoda, Shizuoka-ken, Japan

[73] Assignee: Suzuki Motor Corporation, Shizuoka-ken, Japan

[21] Appl. No.: 09/203,848

[22] Filed: Dec. 2, 1998

[30] Foreign Application Priority Data

Dec. 2, 1997 [JP] Japan ..... 9-345726

[51] Int. Cl.[6] ..... F02M 37/04

[52] U.S. Cl. ..... 123/520; 123/357

[58] Field of Search ..... 123/520, 521, 123/519, 518, 516, 357

[56] References Cited

U.S. PATENT DOCUMENTS

| | | | |
|---|---|---|---|
| 5,176,123 | 1/1993 | Hosoda | 123/357 |
| 5,609,142 | 3/1997 | Osanai | 123/357 |
| 5,634,451 | 6/1997 | Tomisawa | 123/520 |
| 5,694,904 | 12/1997 | Osanai | 125/357 |
| 5,735,255 | 4/1998 | Farmer | 123/520 |
| 5,765,541 | 6/1998 | Farmer | 123/520 |
| 5,767,395 | 6/1998 | Goto | 123/520 |
| 5,850,820 | 12/1998 | Tsutsumi | 123/357 |

FOREIGN PATENT DOCUMENTS

| | | |
|---|---|---|
| 5-156988 | 6/1993 | Japan . |
| 7-166936 | 6/1995 | Japan . |
| 7-259610 | 10/1995 | Japan . |
| 2545438 | 7/1996 | Japan . |
| 8-240138 | 9/1996 | Japan . |

*Primary Examiner*—Carl S. Miller

*Attorney, Agent, or Firm*—Flynn, Thiel, Boutell & Tanis, P.C.

[57] ABSTRACT

An air-fuel ratio controlling apparatus for an internal combustion engine allows an air-fuel ratio learning control to be executed to a satisfactory extent during manufacture in a factory to thereby stabilize exhaust gases and driving performance. The apparatus is provided with a controller which sets air-fuel ratio learning execution counters in a plurality of learning zones. The counters judge whether an air-fuel ratio learning has been executed in an air-fuel ratio learning value storage map based on engine revolutions and engine load, and execute a forced learning control with the amount of purge as a fixed value where the air-fuel ratio learning is not performed at least a preset number of times in all the learning zones with the air-fuel ratio learning execution counters set therein.

6 Claims, 4 Drawing Sheets

AIR-FUEL RATIO LEARNING VALUE STORAGE MAP

LEARNING VALUE STORAGE

AIR-FUEL RATIO LEARNING EXECUTION COUNTER

LEARNING COUNTER

APPARATUS FOR CONTROLLING THE AIR-FUEL RATIO IN AN INTERNAL COMBUSTION ENGINE

FIELD OF THE INVENTION

The present invention relates to an apparatus for controlling the air-fuel ratio in an internal combustion engine and, more particularly, to an apparatus which controls the amount of purge (evaporated fuel) to be fed to an intake system of an internal combustion engine or controls the air-fuel ratio in consideration of individual differences of components associated with the engine.

BACKGROUND OF THE INVENTION

In an internal combustion engine of a vehicle, for the purpose of correcting variations in the manufacture of components associated with the engine such as fuel supply parts, fuel injection valves, air flow meters, oxygen sensors, fuel pressure regulators, as well as variations caused by deterioration of durability, and for controlling the fuel injection volume to a designed median, there is provided a known air-fuel ratio controller which provides an air-fuel ratio learning control to prevent deterioration of exhaust gases and maintain the driving performance in a satisfactory condition.

In the internal combustion engine there also is provided a known evaporated fuel controller for preventing evaporated fuel from flowing out of a fuel tank. The evaporated fuel controller comprises a canister disposed between an evaporation passage communicating with the interior of the fuel tank and a purge passage communicating with an intake system of the engine, and a purge valve disposed in an intermediate position of the purge passage to control the amount of purge (evaporated fuel) to be fed to the intake system in accordance with the operating condition of the engine.

Examples of such air-fuel ratio controllers which control the air-fuel ratio or control the amount of purge are disclosed in Japanese Patent Laid Open Nos. 7-259610, 7-166936, 5-156988 and 8-240138 and Japanese Patent No. 2545438.

According to the apparatus disclosed in Patent Laid Open No. 7-259610, during execution of learning, a learning end condition is judged on the basis of a deviation between an actual air-fuel ratio and a target air-fuel ratio, and when the learning end condition is established, a purge valve is opened, while if the learning end condition is not established for a predetermined period of time, learning is stopped temporarily and the purge valve is opened forcibly, thereby ensuring the discharge of evaporated gas even upon sticking of a learning value in air-fuel ratio learning.

According to the apparatus disclosed in Patent Laid Open No. 7-166936, a dual oxygen feedback control using a rear oxygen sensor is executed whereby, even in the event there continues a state in which an output signal of a downstream-side oxygen sensor is not inverted, a learning value is forcibly updated into an optimal state of emission once a predetermined state is reached.

According to the apparatus disclosed in Patent Laid Open No. 5-156988, a calculated basic fuel injection volume is corrected using both an air-fuel ratio correction coefficient and a learning value, but only when the air-fuel ratio detected by an air-fuel ratio sensor is within a predetermined range at an inversion timing of a target air-fuel ratio and is inverted following the inversion of the target air-fuel ratio. Then a learning value is detected in accordance with the amount of deviation between the air-fuel ratio detected by the air-fuel ratio sensor and a theoretical air-fuel ratio, thereby preventing the learning value from being affected by disturbance.

Japanese Patent Laid Open No. 8-240138 discloses an air-fuel control in a lean-burn type internal combustion engine in which, at a vehicle speed at which the vehicle nearly stops, there is calculated a purge cut time. This calculated time is subtracted during purge, and when the integrated time has reached a predetermined time or more, a purge gas concentration detection end flag is reset, then after start-up, the inhibition of a theoretical air-fuel ratio feedback control is released and an air-fuel ratio feedback control is forcibly executed even during acceleration to estimate a purge gas concentration, then a shift to a lean driving is judged, thereby preventing the air-fuel ratio from becoming rich during lean driving.

According to the apparatus disclosed in Japanese Patent No. 2545438, there is used a control means for performing an air-fuel ratio feedback control forcibly whereby, when an altitude difference in going up and down a slope has reached a predetermined value continuously, a learning control for the air-fuel ratio is executed by an air-fuel ratio feedback control to compensate for a delay in the air-fuel ratio learning control sufficiently and attain a highly accurate air-fuel control.

In the conventional air-fuel ratio controllers for an internal combustion engine, if the air-fuel ratio learning control is performed during purge control in the evaporated fuel controller, the correction of the air-fuel ratio is not effected properly, thus causing deterioration of exhaust gases and of driving performance. As a result, it sometimes becomes necessary to repeat on-off of purge during the air-fuel ratio learning control.

In such a case, however, if the purge-ON frequency of the canister is increased, the air-fuel ratio learning frequency at purge-OFF becomes smaller. Conversely, if the air-fuel ratio learning frequency is increased, the purge-ON frequency becomes smaller. This is inconvenient. Particularly, when exhaust gases are measured during manufacture in a factory, the air-fuel ratio learning control is scarcely performed, thus resulting in deterioration of exhaust gases. In Patent Laid Open No. 7-259610, when the learning end condition does not exist for a certain period of time, the learning control is stopped and the purge valve is opened forcibly, with the air-fuel ratio learning control being not performed during manufacture in a factory, thus causing a fear of deterioration of exhaust gases.

SUMMARY OF THE INVENTION

According to the present invention, for eliminating or minimizing the above-mentioned inconveniences, there is provided an apparatus for controlling the air-fuel ratio in an internal combustion engine of a vehicle wherein a purge control is made for controlling the amount of purge to be fed to an intake system of the engine and a learning control for the air-fuel ratio is performed using an air-fuel ratio learning value while taking into account an individual difference of components associated with the engine. The apparatus includes a control means which sets air-fuel ratio learning execution counters in a plurality of learning zones, the counters judging whether an air-fuel learning has been executed in an air-fuel ratio learning value storage map based on engine revolution and engine load, and which executes a forced learning control with the amount of purge as a fixed value in the case where the air-fuel ratio learning has not been executed a preset number of times or more in all of the learning zones with the air-fuel ratio learning execution counters set therein.

In the present invention, air-fuel ratio learning execution counters are set in a plurality of learning zones, the counters judging whether an air-fuel ratio learning has been executed in an air-fuel ratio learning value storage map based on engine revolution and engine load. When an air-fuel ratio learning is not performed a preset number of times or more in all of the learning zones with the air-fuel ratio learning execution counters set therein, a forced learning control is executed with the amount of purge as a fixed value, whereby an air-fuel ratio learning control, during manufacture in a factory, can be executed to a satisfactory extent and it is possible to stabilize exhaust gases and driving performance, not only during measurement of exhaust gases in a factory, but also at the time of shipping.

Even in the event the backup memory is cleared after appearance on the market, the air-fuel ratio learning can be executed rapidly and it is thereby possible to stabilize exhaust gases and driving performance.

Further, since the canister purge-ON frequency and the air-fuel ratio learning frequency can be controlled appropriately in a separate manner according to situations, it is possible to make the purge control and the air-fuel ratio learning control compatible with each other, whereby exhaust gases and driving performance can be stabilized.

DETAILED DESCRIPTION

Figure 6:
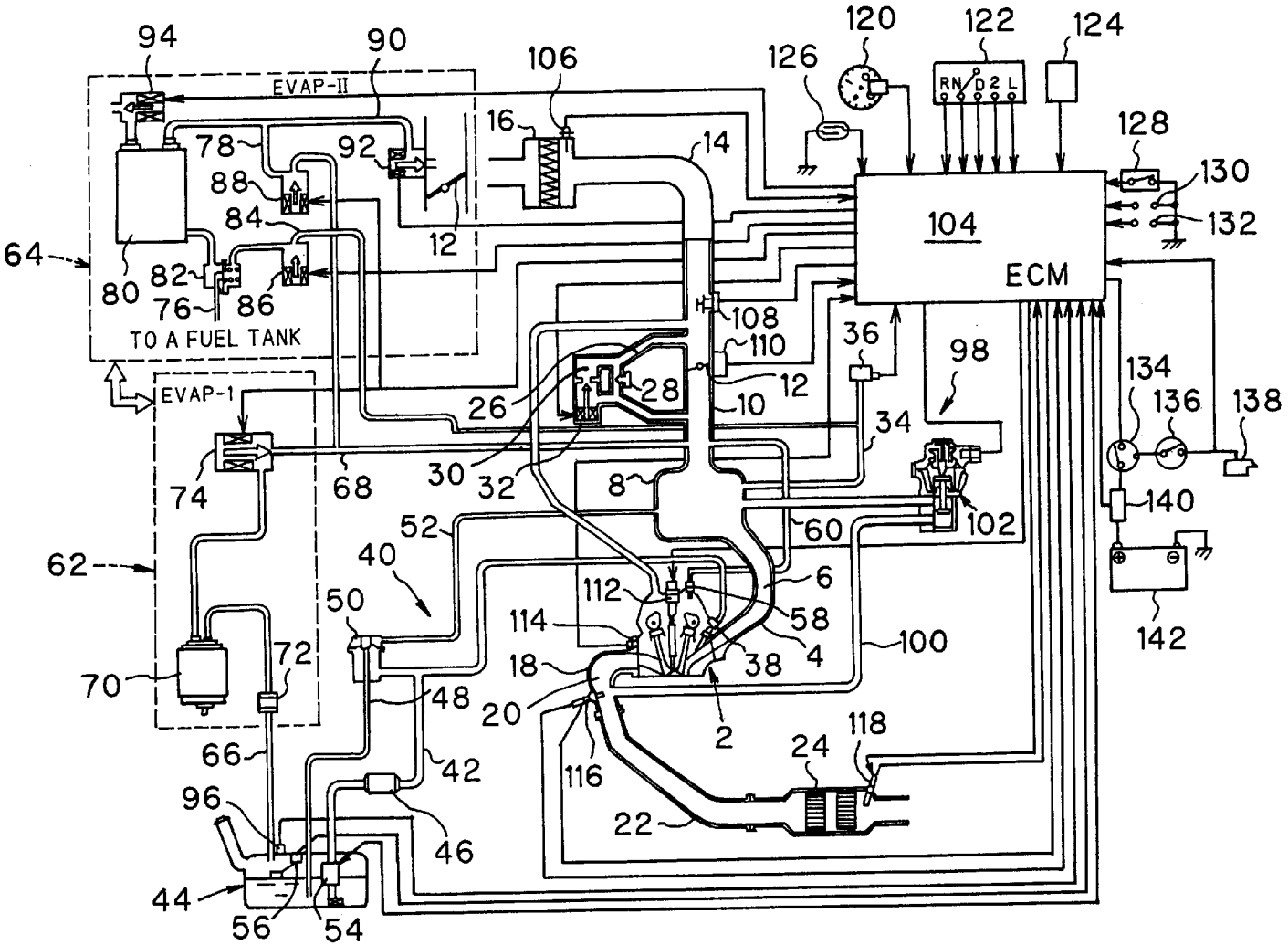
FIG. 6 is a system configuration diagram of an air-fuel ratio control apparatus.

An embodiment of the present invention will now be described in detail with reference to the accompanying drawings. FIGS. 1 to 6 illustrate an embodiment of the present invention. In FIG. 6, the numeral 2 denotes an internal combustion engine mounted on a vehicle, 4 denotes an intake manifold, 6 denotes an intake passage, 8 denotes a surge tank, 10 denotes a throttle body, 12 denotes a throttle valve, 14 denotes an intake pipe, 16 denotes an air cleaner, 18 denotes an exhaust manifold, 20 denotes an exhaust passage, 22 denotes an exhaust pipe, and 24 denotes a catalytic converter.

A by-pass air passage 26 is in communication with the intake passage 6 in such a manner to by-pass the throttle valve 12. In the by-pass air passage 26 there is mounted an idling air adjusting screw 28. Further, an idling air passage 30 is formed in communication with the by-pass passage 26 so as to by-pass the idling air adjusting screw 28. In the idling air passage 30 there is disposed an idling control valve (ISC valve) 32 which is actuated electromagnetically. A pressure introducing passage 34 is in communication with the surge tank 8, with a pressure sensor 36 being mounted in the passage 34. A fuel injection valve 38 is mounted on the internal combustion engine 2.

The fuel injection valve 38 constitutes a fuel feed system 40 and communicates with a fuel tank 44 through a fuel feed passage 42. In the fuel feed passage 42 there is mounted a fuel filter 46, and a fuel return passage 48 is connected to the fuel feed passage 42. In the fuel return passage 48 there is mounted a fuel pressure regulator 50, and a regulator pressure passage 52 for introducing an intake pipe pressure from the surge tank 8 is connected to the fuel pressure regulator 50. In the fuel tank 44 there are disposed a fuel pump 54 and a fuel level sensor 56, with the fuel feed passage 42 being connected to the fuel pump 54.

A positive crank case ventilation (PCV) valve 58 is mounted in the internal combustion engine 2. A blow-by gas passage 60 communicating with the surge tank 8 is connected to the PCV valve 58.

Between the internal combustion engine 2 and the fuel tank 44 are disposed first and second evaporated fuel controllers 62, 64.

In the first evaporated fuel controller 62, a first canister 70 is disposed between a first evaporator passage 66 communicating with the fuel tank 44 and a first purge passage 68 communicating with the surge tank 8. In the first evaporator passage 66 there is disposed a first tank internal pressure control valve 72, and in the first purge passage 68 there is disposed a first purge valve 74 which operates electromagnetically.

In the second evaporated fuel controller 64, a second canister 80 is disposed between a second evaporation passage 76 communicating with the fuel tank 44 and a second purge passage 78 communicating with an intermediate part of the first purge passage 68. In the second evaporation passage 76 there is disposed a second tank internal pressure control valve 82, in which in turn there is disposed a working pressure passage 84 communicating with the pressure introducing passage 34, with a solenoid vacuum valve 86 being disposed in the working pressure passage 84. In the second purge passage 78 there is disposed a second purge valve 88 which operates electromagnetically. Further, in the second purge passage 78 between the second canister 80 and the second purge valve 88 there is disposed a communication passage 90 for diagnosis communicating with the intake passage 6 on an upstream side of the throttle valve 12. In the diagnostic communication passage 90 there is disposed a valve 92 for evaporation diagnosis. In the second canister 80 there is disposed a canister air valve 94. In this second evaporated fuel controller 64, a tank internal pressure sensor 96 is disposed in the fuel tank 44.

Between the surge tank 8 and the exhaust passage 20 there are provided an exhaust gas recirculation (EGR) device 98 and an EGR passage 100, with an exhaust gas recirculation (EGR) control valve 102 being disposed in the EGR passage 100.

The pressure sensor 36, fuel pump 54, fuel level sensor 56, fist purge valve 74, solenoid vacuum valve 86, second purge valve 88, canister air valve 94, tank internal pressure sensor 96 and EGR control valve 102 are connected to an electronic controller or a control means (ECM) 104.

To the electronic control module (ECM) or the control means 104 are also connected an intake air temperature sensor 106 disposed in the air cleaner 16, an intake air volume sensor 108 attached to the intake pipe 14, a throttle sensor 110 attached to the throttle body 10, a spark plug 112 and a cooling water temperature sensor 114 both mounted in the internal combustion engine 2, a front oxygen sensor 116 attached to the exhaust manifold 18, a rear oxygen sensor 118 attached to the exhaust pipe 22 on a downstream side of the catalytic converter 24, a crank angle sensor 120, a range position switch 122 for an automatic transmission, an air conditioner 124, a vehicle speed sensor 126, a power steering pressure switch 128, a diagnostic switch terminal 130, a test switch terminal 132, an ignition switch 134, a shift switch 136, a starter switch 138, a main fuse 140, and a battery 142.

The control means 104 receives various inputs and performs a purge control for controlling the amount of purge to be fed to an intake system of the internal combustion engine 2 and also performs an air-fuel ratio learning control using an air-fuel ratio learning value while taking into account an individual difference of components associated with the engine 2. More specifically, the control means 104 sets an air-fuel ratio learning value storage map (see FIG. 4) having a plurality of learning zones so as to store air-fuel ratio learning values (KLERNA) in terms of engine revolution and engine load, and further sets air-fuel ratio learning execution counters (i=1~8) in a plurality of learning zones (LERNCTi) (see FIG. 5), which counters judge whether an air-fuel ratio learning has been executed in the air-fuel ratio learning value storage map. When the air-fuel ratio learning is not performed a preset number of times (N times) or more in all of the learning zones (LERNCTi) with the air-fuel ratio learning execution counters set therein, the control means 104 executes a forced learning control, for example sets the amount of purge at a fixed value, say, zero or at any constant value without change.

Figure 3:
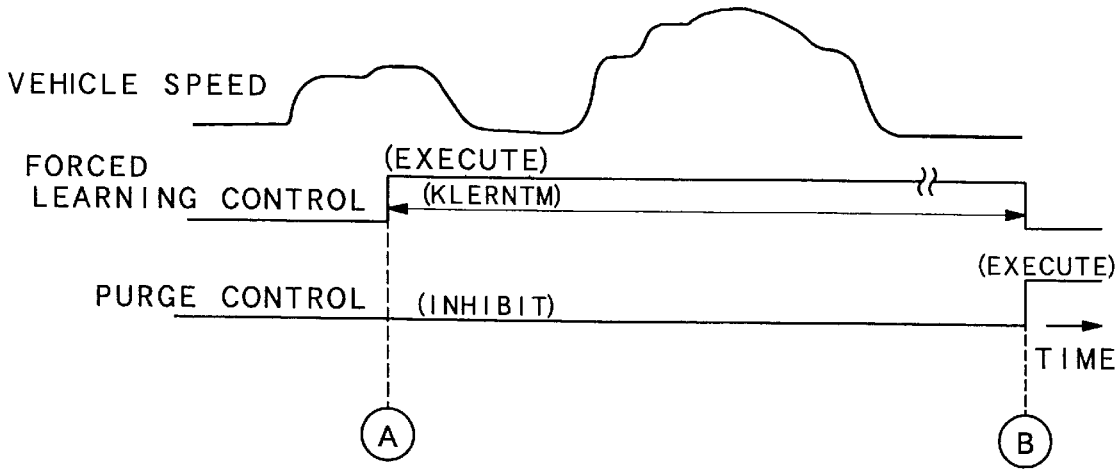
FIG. 3 is a time chart of the air-fuel ratio control.

The above forced learning control, as shown in FIG. 3, is executed until any of the following conditions is satisfied: a certain time (KLERNTM) elapses (indicated at B in FIG. 3) from the time when the forced learning control was started (indicated at A in FIG. 3), an integrated amount of air reaches a preset value, an integrated amount of load reaches a preset value, or an integrated injection volume reaches a preset value. The reason for setting the above certain time (KLERNTM) is as follows: on some particular running conditions, learning may not cover all of plural learning zones, and in this case, if the forced learning control is continued and the purge control is stopped, the amount of purge (evaporated fuel) sucked into the internal combustion engine 2 becomes short, resulting in the leakage of evaporated fuel to the atmosphere in the worst case, which problem and inconvenience is to be avoided.

The control means 104 performs, in a single running of the vehicle, the ordinary purge control with the amount of purge generally not set to a fixed value even in the case where the air-fuel ratio learning is not conducted the preset number of times (N times) in all of the learning zones (LERNCTi) in which the air-fuel ratio learning execution counters have been set.

Figure 1:
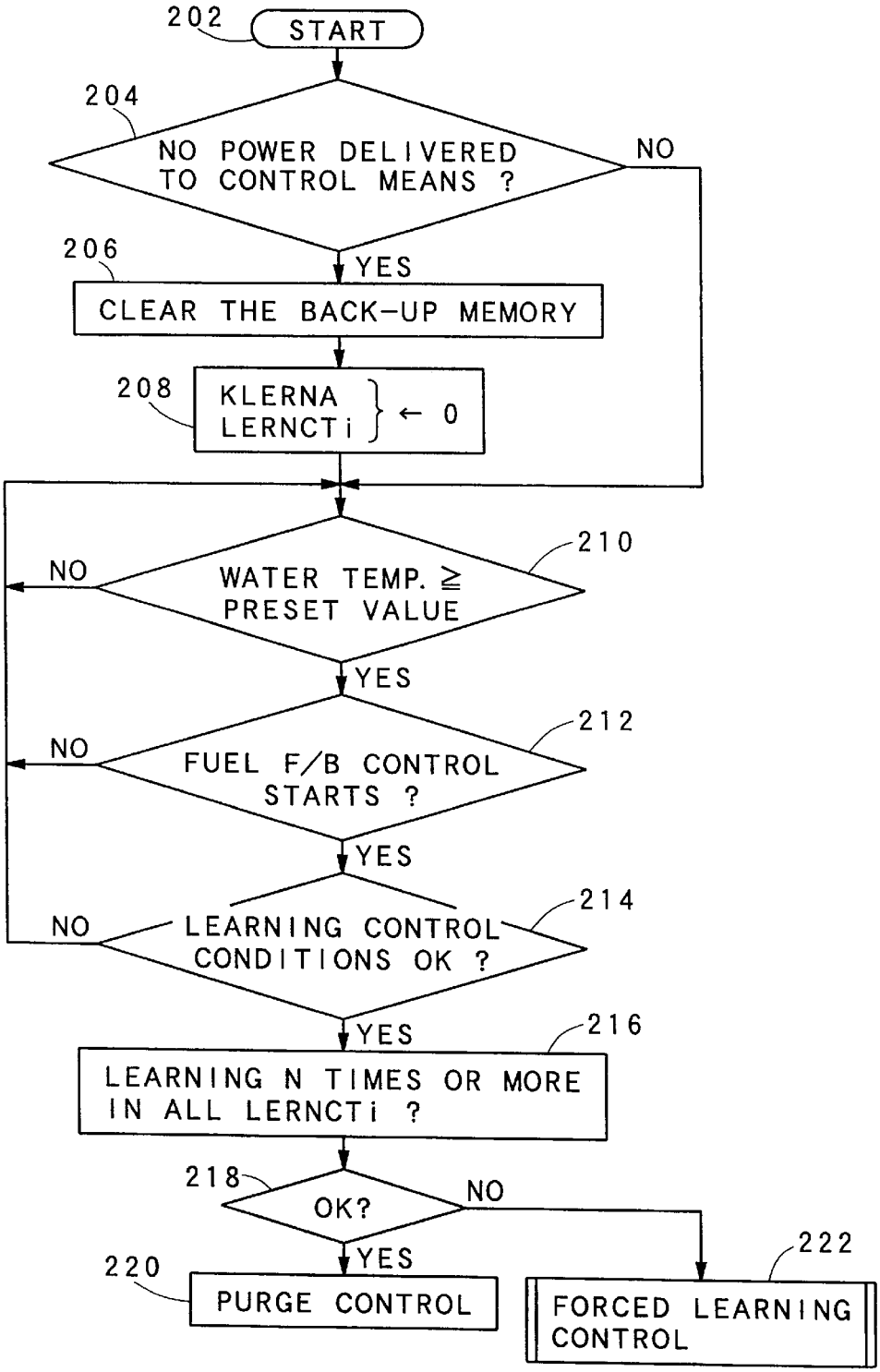
FIG. 1 is a flow chart of an air-fuel ratio control.

The operation of this embodiment will now be described with reference to the flowcharts of FIGS. 1 and 2.

When the program starts (step 202), there is made judgment in the control means 104 as to whether the battery 142 has been cleared (step 204) i.e., in a state in which no power is being delivered from the battery 142 to the control means 104.

Figure 4:
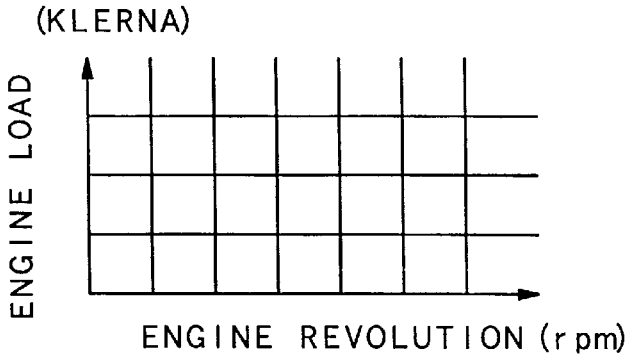
FIG. 4 is a diagram of an air-fuel ratio learning value storage map.
Figure 5:
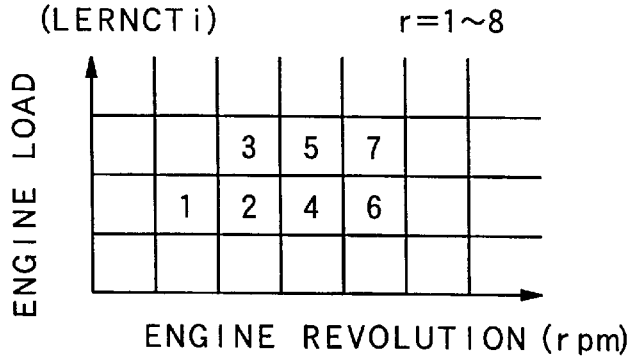
FIG. 5 is a diagram explanatory of learning zones with air-fuel ratio learning execution counters set therein.

If the answer in step 204 is affirmative, that is, if the battery 142 has been disconnected (delivering no power to control means 104), or if the vehicle concerned is fresh from a factory, a back-up memory is cleared (step 206). A check is made to make sure that the air-fuel ratio learning has been cleared or is not being executed (KLERNA←0, LERNCTi←0) (step 208). Air-fuel ratio learning values are stored in the back-up memory, as shown in FIG. 4.

After step 208 and if the answer in step 204 is negative, there is made judgment as to whether the cooling water or cooling liquid temperature is equal to or higher than a preset value (step 210). If the answer in step 210 is negative, this judgment is continued.

If the answer in step 210 is affirmative, judgment is made as to whether a fuel feedback control starts or not (step 212). If the answer in step 212 is negative, the flow returns to step 210.

If the answer in step 212 is affirmative, judgment is made as to whether predetermined learning control conditions exist or not (step 214). If the answer in step 214 is negative, the flow returns to step 210.

Each learning zone (LERNCTi) with an air-fuel ratio learning execution counter set therein is incremented +1 after learning, and count-up is continued until execution of N-time air-fuel ratio learning which has been set in each learning zone (LERNCTi) (step 216). Each learning zone corresponds to predetermined ranges for values for engine speed and engine load. The air-fuel ratio learning values are stored in the back-up memory.

Next, after start-up of the internal combustion engine 2, judgment is made as to whether air-fuel ratio learning has been conducted N times or more in all the learning zones (LERNCTi) (step 218).

If the answer in step 218 is affirmative, the first and second purge valves 74, 88 are subjected to an appropriate duty control and there is conducted the ordinary purge control (step 220).

On the other hand, if the answer in step 218 is negative, that is, if air-fuel ratio learning is not conducted N times or more in any of the learning zones (LERNCTi), there is conducted a forced learning control (step 222).

Figure 2:
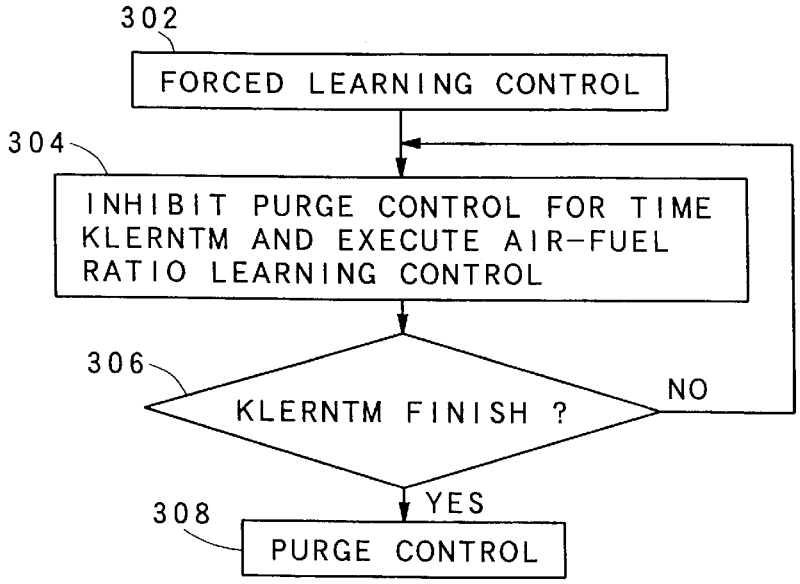
FIG. 2 is a flow chart of a forced learning control.

The forced learning control is performed as in FIG. 2. In this embodiment, once this control starts (step 302), purge control is inhibited (purge-cut), that is, the amount of purge is set to zero, for only a predetermined or certain time (KLERNTM) which has been set as a condition, and the air-fuel ratio learning control is executed forcibly (step 304) (indicated at A in FIG. 3).

Then, judgment is made as to whether the certain time (KLERNTM) has elapsed or not (step 306). If the answer in step 306 is negative, the flow returns to step 304.

If the answer in step 306 is affirmative, the above purge control is executed (step 308) (indicated at B in FIG. 3).

If an attempt is made to subject all the learning zones (LERNCTi) to air-fuel ratio learning N times or more in a single running of the vehicle, the running condition of the vehicle may leave the purge control unexecuted, which may result in the leakage of evaporated fuel to the atmosphere in the worst case. To avoid this inconvenience, the purge control is made in every single running of the vehicle.

As a result, when the battery 142 is off or during manufacture in a factory and when an air-fuel ratio value in the back-up memory is not appropriate, the air-fuel ratio learning control can be executed to a satisfactory extent by the forced learning control which makes the air-fuel ratio learning control while cutting the purge. Thus, not only during measurement of exhaust gases in the factory, but also at the time of shipping, it is possible to stabilize the exhaust gases and driving performance.

Even in the event the back-up memory should be cleared after arrival on the market, the exhaust gases and the driving performance can be stabilized because it is possible to execute the air-fuel ratio learning control rapidly.

Further, since the purge frequency in each canister and the air-fuel ratio learning frequency can be controlled appropriately in a separate manner according to situations, it is possible to make both purge control and air-fuel ratio learning control compatible with each other and hence possible to stabilize exhaust gases and driving performance.

Although in the above embodiment the purge control is inhibited and the amount of purge is set to a fixed value of zero during the period of a certain time (KLERNTM) which is one of the conditions for executing the forced learning control, the forced learning control may be performed using any fixed, constant, change-free value as the amount of purge during the period of the certain time (KLERNTM). In this case, even if there is an amount of purge, the amount of purge is constant, and therefore the air-fuel ratio control can be performed properly by the forced learning control.

As will be seen from the above detailed description, the air-fuel ratio controlling apparatus is provided with control means 104 which sets air-fuel ratio learning execution counters in a plurality of learning zones, the counters judging whether an air-fuel ratio learning has been executed or not in an air-fuel ratio learning value storage map based on engine revolution and engine load, and executes a forced learning control with the amount of purge set to a fixed value in the case where the air-fuel ratio learning has not been performed at least a preset number of times in all the learning zones with the air-fuel ratio learning execution counters set therein. As a result, the air-fuel ratio learning control can be performed to a satisfactory extent during manufacture in a factory and it is possible to stabilize exhaust gases and driving performance not only during the measurement of exhaust gases in the factory, but also at the time of shipping.

Even in the event the back-up memory should be cleared after arrival on the market, it is possible to execute the air-fuel ratio learning control rapidly and hence possible to stabilize exhaust gases and driving performance.

Further, since the purging frequency in each canister 70, 80 and the air-fuel ratio learning frequency can be controlled appropriately in a separate manner according to situations, it is possible to make both purge control and air-fuel ratio learning control compatible with each other and exhaust gases and driving performance can be kept stable.

Although particular embodiments of the invention have been disclosed in detail for illustrative purposes, it will be recognized that variations or modifications of the disclosed apparatus, including the rearrangement of parts, lie within the scope of the present invention.

What is claimed is:

1. A method for controlling the air-fuel ratio in an internal combustion engine, comprising the steps of:

detecting cooling liquid temperature of the engine and comparing the liquid temperature to a preset value, and repeating detection of the liquid temperature if the liquid temperature is less than the preset value until the liquid temperature is equal to or greater than the preset value;

detecting whether a fuel feedback control starts and returning to the cooling liquid temperature detection step if the fuel feedback control is not started;

sensing the presence of predetermined learning control conditions and returning to the cooling liquid temperature detection step if the predetermined learning control conditions do not exist; and sensing whether or not air-fuel ratio learning has been conducted at least N times or more in all learning zones, where N is an integer, and if all learning zones contain the appropriate air-fuel ratio learning, then controlling first and second purge valves, and if the air-fuel ratio learning has not been conducted at least the appropriate number of times, applying a forced learning control to the engine.

2. The method according to claim 1, wherein the forced learning control further comprises the steps of:

forcibly executing the air-fuel ratio learning control;

detecting whether a predetermined certain time has elapsed, and returning to the air-fuel ratio learning control step until such time has elapsed.

3. The method according to claim 2, wherein, upon completion of the predetermined certain time, purge control of the engine occurs.

4. An apparatus for controlling the air-fuel ratio in an internal combustion engine of a vehicle wherein a purge control is made for controlling the amount of purge to be fed to an intake system of the engine and a learning control for the air-fuel ratio is performed using an air-fuel ratio learning value while taking into account individual differences of components associated with the engine, the apparatus including a control means which sets air-fuel ratio learning execution counters in a plurality of learning zones, said counters judging whether an air-fuel learning has been executed in an air-fuel ratio learning value storage map based on engine revolution and engine load, and said control means executes a forced learning control with the amount of purge as a fixed value in the case where the air-fuel ratio learning has not been executed at least a preset number of times in all of the learning zones with the air-fuel ratio learning execution counters set therein.

5. An apparatus according to claim 4, wherein said forced learning control is continued until any one of the following conditions is satisfied: a) a certain time elapsing from the time when the forced learning control was started, b) an integrated amount of air reaching a preset value, c) an integrated amount of load reaching a preset value, and d) an integrated injection volume reaching a preset value.

6. An apparatus according to claim 4, wherein said control means executes the purge control with the amount of purge not set at a fixed value even when in a single travel of the vehicle the air-fuel ratio learning is not performed the preset number of times in all of the learning zones with said air-fuel ratio learning execution counters set therein.

* * * * *